United States Patent [19]

Miyata

[11] Patent Number: 4,943,692

[45] Date of Patent: Jul. 24, 1990

[54] COVER INTEGRATED LEAF SWITCH

[75] Inventor: Muneyoshi Miyata, Tokyo, Japan

[73] Assignee: Mitsuku Denshi Kogyo Kabushiki Kaisha, Tokyo, Japan

[21] Appl. No.: 329,569

[22] Filed: Mar. 28, 1989

[51] Int. Cl.[5] ..... H01H 1/24

[52] U.S. Cl. ..... 200/283

[58] Field of Search ..... 200/283

[56] References Cited

U.S. PATENT DOCUMENTS 3,548,131 12/1970 Piber ..... 200/295 X 4,453,058 6/1984 Miyata ..... 200/283

*Primary Examiner*—Renee S. Luebke

*Attorney, Agent, or Firm*—Oblon, Spivak, McClelland, Maier & Neustadt

[57] ABSTRACT

Disclosed is a leaf switch having an integral cover, and including an insulating base (1), two leaf spring elements (*3a, 3b*) embedded in the base (1), and a cover (2) consisting of two cover halves (*2a, 2b*) integrally connected to each other through a hinge portion (*2c*). One of the cover halves (*2b*) is pivotable about the hinge portion (*2c*) to a position in which it engages the other cover half (*2a*), thereby forming the cover (2) which envelops the leaf spring elements (*3a, 3b*). The base (1) and cover (2) are formed from a plastic material by concurrent integral molding.

8 Claims, 3 Drawing Sheets

COVER INTEGRATED LEAF SWITCH

BACKGROUND OF THE INVENTION

1. Field of the Invention

The present invention relates to a leaf switch with a cover, or a cover integrated leaf switch, of the type in which contact leaf spring elements are embedded in an insulating base adapted to be mounted on a mechanical chassis of electronic equipment, or on its printed board or the like by insert molding, and more particularly to such a leaf switch in which the switch mechanism is enveloped by the cover which is concurrently formed integrally with the insulating base by simultaneous integral molding during the embedding operation.

2. Description of the Prior Art

A conventional leaf switch having a cover attached thereto or a cover attached leaf switch is generally constructed so that a cover formed separately from the insulating base is fitted to the switch mechanism mounted on the insulating base. This construction requires separate manufacture of the leaf switch body and cover using respective molds. Also, the leaf switch body and cover so formed are then assembled to produce the finished leaf switch. Thus, it will be noted that manufacturing the conventional cover attached leaf switch is very costly and requires considerable time and labor.

SUMMARY OF THE INVENTION

The present invention has been made in view of the foregoing disadvantage of the prior art.

Accordingly, it is an object of the present invention to provide a leaf switch construction which is capable of being readily manufactured at reduced costs, with less time and labor required.

According to the invention, there is provided a leaf switch having an integral cover, comprising: an insulating base; a plurality of leaf spring elements embedded in the base: and a cover consisting of at least two cover parts integrally connected to each other through at least one hinge portion; one or more of the cover parts being pivotable about the hinge portion or portions to a position in which they engage each other, thereby forming the cover which envelops the leaf spring elements; the base and cover being formed from a plastic material by concurrent integral molding.

Preferably, the cover is formed by fitting two cover halves together to form a rectangular box-like shape. Preferably, one cover half is generally L-shaped and the other cover half is generally U-shaped, the L-shaped cover half being integrally connected through a base portion to the insulating base during the molding operation, the base portion serving as a second hinge portion.

Thus, a preferred cover integrated leaf switch of the present invention is of the type in which two contact leaf spring elements are embedded in an insulating base by insert molding of a plastic material. The cover is formed integrally with the insulating base so as to be integrally connected to the insulating base by concurrent integral molding while the leaf spring elements are embedded in the insulating base. The cover comprises two cover halves formed integrally with each other, of which one is pivotable about a hinge portion on the other cover half, resulting in the cover being formed or closed to envelop the switch mechanism.

In one preferred form, the leaf switch is of the normally open type having two leaf spring elements and having a spacer located on one of the leaf spring elements to separate them, and also having an operating member arranged to move the two leaf spring elements together. The operating member may be on one of the leaf spring elements or on the cover.

In an alternative preferred form, the leaf switch is of the normally closed type having two leaf spring elements, the cover having an operating member and an engagement element arranged to engage one of the leaf spring elements.

The invention also extends to a method of forming a leaf switch by simultaneously integrally molding the insulating base, the cover and any other plastics components, and embedding the leaf spring elements in the base.

BRIEF DESCRIPTION OF THE DRAWINGS

These and other objects and many of the attendant advantages of the present invention will be readily appreciated as the same becomes better understood by reference to the following detailed description when considered in connection with the accompanying drawings in which like reference numerals designate like or corresponding parts; wherein:

FIG. 1(*b*) is a side elevational view of the leaf switch shown in FIG. 1(*a*);

FIG. 1(*c*) is a bottom plan view of the leaf switch shown in FIG. 1(*a*);

FIG. 1(*d*) is an end elevational view of the leaf switch shown in FIG. 1(*a*);

FIG. 1(*e*) is a view similar to FIG. 1(*b*) with the cover closed;

FIG. 2(*b*) is a side elevational view of the leaf switch shown in FIG. 2(*a*) with the cover closed.

FIG. 3(*b*) is a side elevational view of the leaf switch shown in FIG. 3(*a*) with the cover closed.

DESCRIPTION OF THE PREFERRED EMBODIMENT

Figure 1A:
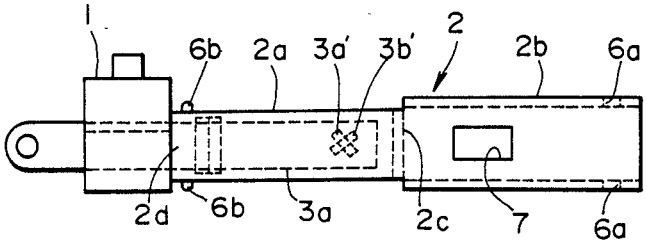
FIG. 1(*a*) is a plan view of a cover integrated leaf switch of the sensor type in the as-molded or open condition.
Figure 1B:
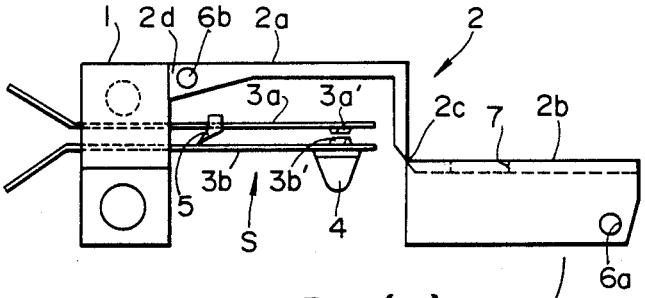
Figure 1D:
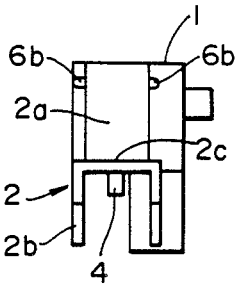
Figure 1C:
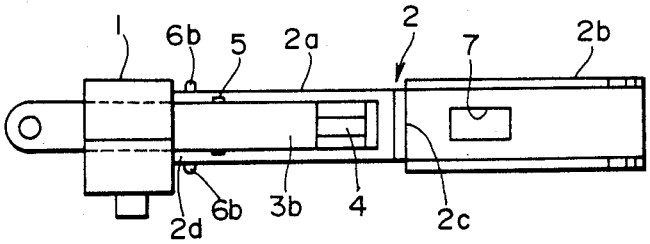
Figure 1E:
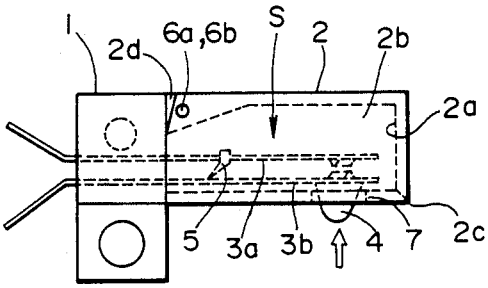

A cover integrated leaf switch according to the present invention will be now described hereinafter with reference to the accompanying drawings.

First, a general construction of a cover integrated leaf switch in accordance with the present invention will be described with reference to FIGS. 1(*a*) to 3(*b*).

A cover integrated leaf switch includes an insulating base 1 and two contact leaf spring elements 3*a* and 3*b* embedded in the insulating base 1 by insert molding of a plastics material. Naturally, more than two elements may be employed. The switch also includes a cover 2 constituted by a first cover half 2*a* and a second cover half 2*b* which are integrally connected together through a longitudinally transversely oriented hinge portion 2*c* of reduced thickness at longitudinal end portions of the first and second cover halves. The cover 2 is integrally mounted on or connected to the insulating base 1.

The insulating base 1 and cover 2 constructed as described above are concurrently or simultaneously formed by concurrent or simultaneous integral molding.

Pivotal movement of the second cover half 2*b* about the hinge portion 2*c* causes it to fit on to the first cover half 2*a*, resulting in the cover 2 being formed or closed to sheath or envelop the switch mechanism S of the leaf switch. The cover 2 formed in this way, may take any suitable shape so long as it can effectively cover the switch mechanism S. For example, it may be formed into a rectangular box-like shape by forming the first and second cover halves 2*a* and 2*b* into an L-shape and a U-shape, respectively, and longitudinally fitting the cover halves 2*b* and 2*a* together by pivotal movement of the cover half 2*b* about the hinge portion 2*c*.

In the concurrent integral molding operation of the insulating base 1 and cover 2, the first cover half 2*a* which is of an L-shape, is formed so as to have a base portion 2*d* serving as a mount or hinge through which the first cover half 2*a* is integrally mounted on the insulating base 1.

Inter-engagement of the two cover halves 2*a* and 2*b* is effected by means of a suitable engagement structure such as small apertures 6*a* and small projections 6*b* associated with the cover halves 2*a* and 2*b*, respectively.

Structural elements including an operating member 2*e*, and engagement member 2*f* and the like provided on at least one of the cover halves 2*a* and 2*b*, and an operating element 4, a spacer 5 and the like formed on at least one of the contact leaf spring elements 3*a* and 3*b* are also formed concurrently during the concurrent integral molding operation.

It will therefore be understood that formation of the cover integrated leaf switch is carried out using a single molding with a molding section for forming the insulating base and a mold section for forming the cover which are communicated with each other.

The present invention will now be described with reference to three typical embodiments, however, the present invention is not limited to these embodiments. The present invention may be embodied in any other suitable manner so long as the cover is formed integrally with the insulating base by concurrent integral molding and effectively envelops the switch mechanism.

The cover integrated leaf switch shown in FIGS. 1(*a*) to 1(*c*) comprises an insulating base 1 and the cover 2. The cover 2 includes a first cover half 2*a* which is L-shaped. It has a base portion 2*d* at its proximal end which serves as a mount while at its distal end, it has a hinge portion 2*c* of a smaller thickness. The first cover half 2*a* is integrally connected through the base portion 2*d* to the insulating base 1. The cover 2 also includes a second cover half 2*b* which is U-shaped and which is connected through the hinge portion 2*c* to the first cover half 2*a*. The cover 2 is formed integrally with the insulating base 1 by concurrent integral molding.

During the molding operation, an operating member 4 is formed on the leaf spring element 3*b* and a spacer 5 is formed on the leaf spring element 3*b*. The spacer normally separates the two leaf spring elements 3*a*, 3*b*.

The second cover half 2*b* has small apertures 6*a* which co-operate with small projections 6*a* on the first cover half 2*a* to constitute an engagement structure. The second cover half 2*b* is formed with a window 7 through which the operating member 4 projects when the cover 2 is closed.

The cover 2 is closed by pivoting the second cover half 2*b* about the hinge portion 2*c* until the small apertures 6*a* of the cover half 2*a* and the small projections 6*b* of the second cover half 2*b*, come into engagement, to produce a rectangular box-like shape.

In this position, the operating member 4 of the contact leaf spring element 3*b* projects through the window 7 of the second cover half 2*b*. When any external force is applied to the operating element 4, the contact leaf spring element 3*b* is inflected resulting in contact between the contacts 3*a*′ and 3*b*′.

Figure 2A:
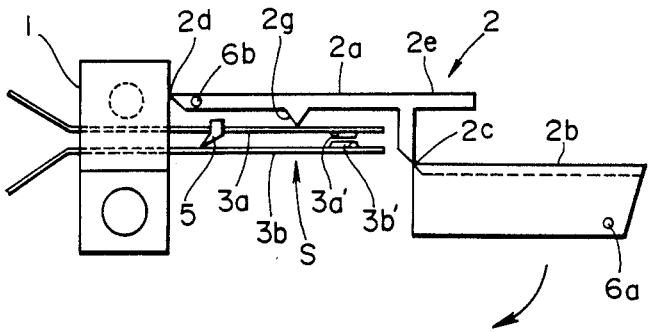
FIG. 2(*a*) is a side elevational view similar to FIG. 1(*a*) showing another embodiment of the present invention, in this case a leaf switch of the normally open type.
Figure 2B:
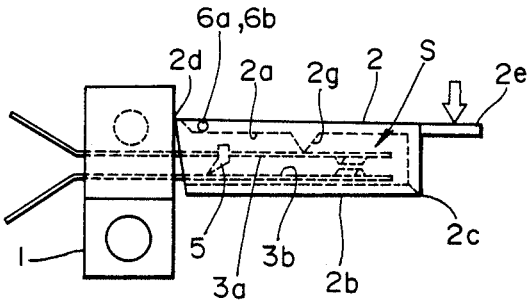

FIGS. 2(*a*) and 2(*b*) show a normally open type leaf switch in which the contacts 3*a*′ and 3*b*′ are normally separated from each other, resulting in the switch being normally turned off.

Again, the leaf switch includes an insulating base 1 and a cover 2. The cover 2 includes a first cover half 2*a* which is L-shaped and has at its proximal end a base portion 2*d* in this case of a reduced thickness which serves as a hinge portion. At its distal end, it has a hinge portion 2*c*. The first cover half 2*a* is integrally connected through the base portion 2*d* to the insulating base 1. The cover 2 also includes a second cover half 2*b* which is U-shaped and which is integrally connected through the hinge portion 2*c* to the first cover half 2*a*. The cover 2 is formed integrally with the insulating base 1 by concurrent integral molding.

In this embodiment, however, there is no operating member on the leaf spring element 3*b*. Indeed, during the molding operation, an operating member is formed on the first cover half 2*a*. In addition, the first cover half 2*a* is formed with a support element 2*g* which may abut the leaf spring element 3*a*.

The remainder of the leaf switch shown in FIGS. 2(*a*) and 2(*b*) is constructed in substantially the same manner as that shown in FIGS. 1(*a*) to 1(*e*).

The cover 2 is closed by pivoting the second cover half 2*b* about the hinge portion 2*c* until the small apertures 6*a* of the second cover half 2*b* and the small projections 6*b* of the first cover half 2*a* come into engagement.

When a force is applied to the operating member 2*e*, the cover 2 pivots about the base or hinge portion 2*d*. This results in the support element 2*g* inflecting the contact leaf spring element 3*a*, leading to contact between the contacts 3*a*′ and 3*b*′, and so the switch is turned on.

Figure 3A:
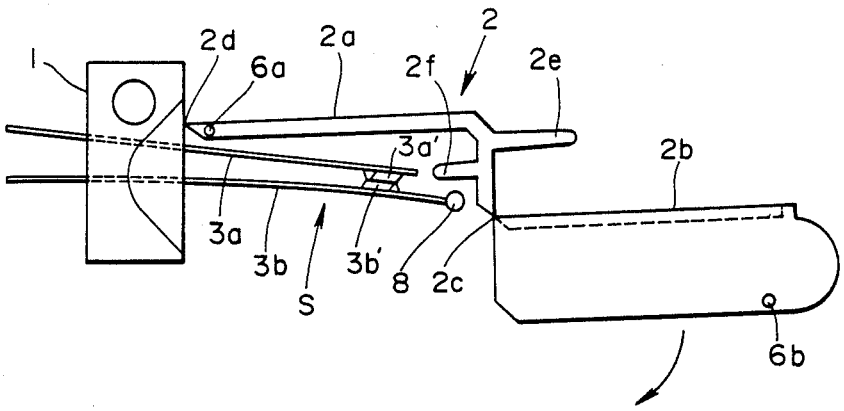
FIG. 3(*a*) is a side elevational view similar to FIG. 1(*a*) showing a further embodiment of the present invention, in this case a leaf switch of the normally closed type.
Figure 3B:
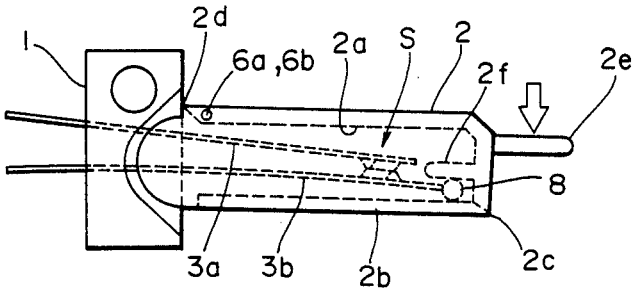

FIGS. 3(*a*) and 3(*b*) show a normally closed type leaf switch in which the contacts 3*a*′ and 3*b*′ are normally in contact with each other, resulting in the switch being normally turned on.

Again, the leaf switch includes an insulating base 1 and a cover 2. The cover 2 includes a first cover half 2*a* which is L-shaped and has at its proximal end, a base portion 2*d* which serves as a hinge portion. At its distal end, it has a hinge portion 2*c*. The first cover half, 2*a* is integrally connected through the base portion 2*d* to the insulating base 1. The cover 2 also includes a second cover half 2*b* which is U-shaped and which is integrally connected through the hinge portion 2*c* to the first cover half 2*a*. The cover 2 is formed integrally with the insulating base 1 by concurrent integral molding.

In this embodiment, an operating member 2*e* and an engagement element 2*f* are formed on the first cover half 2*a*. In addition, an engagement element 8 is formed on the end of the leaf spring element 3*b*. Since the switch is normally closed, there is no spacer between the leaf spring elements 3*a*, 3*b*.

The cover 2 is closed by pivoting the second cover half 2*b* about the hinge portion 2*c* until there is engagement between the small apertures 6*a* in the first cover half 2*a* and small projections 6*b* on the second cover half 2*b*. In this condition, the engagement element 8 comes into contact with the engagement element 2*f*.

When a force is applied to the operating member 2*e*, the cover 2 pivots about the hinge portion 2*d*. This causes the engagement element 2*f* to force the engagement element 8 to inflect the contact leaf spring element 3*b*, resulting in the contact 3*b*′ being separated from the contact 3*a*′.

As can be seen from the foregoing, the cover integrated leaf switch is constructed by simultaneously forming the cover integrally with the insulating base so as to mount the cover on the insulating base through the base portion, when the contact leaf spring elements are embedded in the insulating base by insert molding. Accordingly, the present invention effectively eliminates the disadvantages encountered with the prior art arrangement in which the leaf switch and the cover are separate from each other.

Also, in the present invention, one cover half is pivotally connected through the hinge portion of reduced thickness to the other cover half and when pivoted about the hinge portion, it fits on the other cover half, resulting in the cover being formed or closed. Furthermore, the base portion of the cover is integrally connected through the base portion which serves as the mount and/or hinge portion to the insulating base. As a result, the insulating base and cover are formed by means of a mold in which one cover half is kept open and therefore does not interfere with the insert molding of the switch mechanism.

At the same time, additional structural elements such as the operating members, spacer etc. are simultaneously formed without difficulty.

The cover is formed by closing the two cover halves, thus rigidly enveloping the switch mechanism.

To execute switching operation, it is merely necessary to push the operating member which is either part of the cover or projects out through the cover. Thus, switching operation is readily and smoothly accomplished without difficulty.

While preferred embodiments of the present invention have been described with a certain degree of particularity with reference to the drawings, obvious modifications and variations are possible in light of the above teachings. It is therefore to be understood that within the scope of the appended claims, the invention may be practiced otherwise than as specifically described.

I claim:

1. A leaf switch having an integral cover comprising:

an insulating base;

a plurality of leaf spring elements embedded in the base;

a cover integrally connected to said insulating base and which comprises a first and a second interengageable cover part longitudinally connected to each other through a longitudinally transversely oriented hinge portion; said first and second cover parts having a first and a second engagement member, respectively, and being pivotable about the hinge portion from an open position to a closed position for forming the cover and to envelop the leaf spring elements; the base and cover being formed from a plastic material by concurrent integral molding.

2. A leaf switch as defined in claim 1, wherein said first and second cover parts comprise first and second cover halves which together form a rectangular box-like shape.

3. A leaf switch as defined in claim 1 wherein each hinge portion consists of a region of reduced thickness.

4. A leaf switch as defined in claim 1 wherein the leaf switch is of a normally closed type having two leaf spring elements, the cover having an operating member mounted thereon and an engagement element for engaging one of the leaf spring elements.

5. A leaf switch as defined in claim 1 wherein the leaf switch is of a normally open type and having a spacer located on one of the leaf spring elements to separate them, and also having an operating member for moving the two leaf spring elements together.

6. A leaf switch as defined in claim 5 wherein the operating member is mounted on one of said leaf spring elements.

7. A leaf switch as defined in claim 5 wherein the operating member is mounted on the cover.

8. A leaf switch having an integral cover, comprising:

an insulating base;

a plurality of leaf spring elements embedded in the base;

a cover which includes at least two interengageable cover parts integrally and longitudinally connected to each other through at least one hinge cover portion;

said cover parts being pivotable about said at least one hinge portion to a closed position in which said cover parts engage each other, wherein the cover parts envelop said leaf spring elements, the case and cover are formed from a plastic material by concurrent integral molding and wherein said cover parts together form a rectangular box-like shape wherein one cover part is generally L-shaped and the other cover part is generally U-shaped, the L-shaped cover part being integrally connected through a base portion to the insulating base during a molding operation, the base portion serving as a second hinge portion.

* * * * *